US008499369B2

(12) United States Patent
Ahmady

(10) Patent No.: US 8,499,369 B2
(45) Date of Patent: Aug. 6, 2013

(54) TANK WATER CONSERVATION SYSTEM

(76) Inventor: Shervin Shokouh Ahmady, Marietta, GA (US)

( * ) Notice: Subject to any disclaimer, the term of this patent is extended or adjusted under 35 U.S.C. 154(b) by 13 days.

(21) Appl. No.: 12/750,300

(22) Filed: Mar. 30, 2010

(65) Prior Publication Data

US 2010/0243064 A1 Sep. 30, 2010

Related U.S. Application Data

(60) Provisional application No. 61/202,731, filed on Mar. 31, 2009.

(51) Int. Cl.
*E03D 1/34* (2006.01)

(52) U.S. Cl.
USPC ..... 4/388; 4/415; 4/324

(58) Field of Classification Search
USPC ..... 4/385, 386, 388, 392, 324, 325, 378
See application file for complete search history.

(56) References Cited

U.S. PATENT DOCUMENTS

| | | | | | |
|---|---|---|---|---|---|
| 2,112,630 | A * | 3/1938 | Marshall | 137/856 |
| 2,504,555 | A | 4/1950 | Loether | |
| 2,520,059 | A | 8/1950 | Reeves | |
| 2,787,004 | A * | 4/1957 | Zinkll et al. | 251/358 |
| 3,036,313 | A | 5/1962 | Jenkins | |
| 3,095,577 | A * | 7/1963 | Clark | 4/333 |
| 3,173,152 | A * | 3/1965 | McCrink | 4/314 |
| 3,982,283 | A | 9/1976 | Goldring | |
| 4,364,129 | A | 12/1982 | Schonger | |
| 4,455,694 | A | 6/1984 | Dymon | |
| 5,073,995 | A | 12/1991 | Jennison et al. | |
| 5,129,110 | A | 7/1992 | Richter | |
| 5,191,662 | A * | 3/1993 | Sharrow | 4/325 |
| 5,428,848 | A | 7/1995 | Battle | |
| 6,615,415 | B1 * | 9/2003 | Lai | 4/392 |
| 2010/0275360 | A1 * | 11/2010 | Hammons | 4/324 |

* cited by examiner

*Primary Examiner* — Tuan N Nguyen
*Assistant Examiner* — Erin Deery
(74) *Attorney, Agent, or Firm* — Crose Law LLC; Bradley D. Crose

(57) ABSTRACT

A water conservation device for use within a toilet is disclosed. In at least one embodiment, the device includes a connector having a base adapted for connectivity and placement adjacent to a traditional pole assembly and proximate to an opening valve within a tank of the toilet. In at least one embodiment, the device includes a flexible pressure arm integrally formed with the connector base and adapted to couple to the opening valve within the tank of the toilet and adapted to provide a pressure to the opening valve to lessen overall water utilized in each flush of the toilet and thereby conserve water. The water conservation device is adapted for either a total or partial flush of the toilet as selected by a user.

8 Claims, 13 Drawing Sheets

TANK WATER CONSERVATION SYSTEM

CROSS-REFERENCE TO RELATED APPLICATION(S)

The present non-provisional patent application claims the benefit of priority of U.S. Provisional Patent Application No. 61/202,731 which is entitled "TANK WATER CONSERVATION", which was filed on Mar. 31, 2009, and which is incorporated in full by reference herein.

FIELD OF THE INVENTION

The technology described herein relates generally to the fields of water conservation and toilet flush systems. More specifically, this technology relates to an apparatus for a toilet flush system adapted to control the flow of water and thereby conserve water.

BACKGROUND OF THE INVENTION

A toilet is a plumbing fixture and disposal system configured for the disposal of bodily waste products. Many toilets consist of a tank section and a bowl section. The tank section is adapted to hold flush water to be used when the toilet is flushed. The bowl section contains water and is adapted to receive solid and/or liquid human waste products and then be flushed. Deposited human waste products in the bowl section are removed by a flushing process which releases water held in the tank section into the bowl section. The released water removes the waste products to a sewer system, septic tank, or the like. The bowl section then automatically is refilled with new water such that standing water remains in the bowl section. The tank section likewise is refilled automatically with water to be ready for the next toilet flush In many plumbed buildings having toilets, the largest use of water is that required to flush toilets. Because flushing utilizes all of the water stored in the tank section, the water usage is wasteful and is not required. The actual water needed for flushing can vary based on what waste products needs to be flushed. Considerable interest has been placed on reducing the water used when toilets are flushed, especially at times and in places when there is a water deficiency or a period of drought. Numerous devices have been developed to conserve flush water in a toilet tank and control the flow of water therefrom. Consider, for example, that pre-1994, most toilets used 3.4 gallons of water or more per flush. Since that time, and in response to federal legislation, toilets have been improved to use only 1.6 gallons of water per flush. Known systems include those utilizing dual flush tanks with two flush options, such as one for liquid waste disposal and one for solid waste disposal. However, even low-flow and high-efficiency toilets have known deficiencies and limitations. Additionally, a known work-around to lessen the water usage in a toilet is to utilize an object such as a brick or enclosed bag of water placed within the tank to lessen the area in which tank water can fill, and thereby reduce the water used in a flush.

Related patents and published patent applications known in the background art include the following: U.S. Pat. No. 2,504,555, issued to Loether on Apr. 18, 1950, discloses a flush valve. U.S. Pat. No. 2,520,059, issued to Reeves on Aug. 22, 1950, discloses a flush tank ball valve. U.S. Pat. No. 3,036,313, issued to Jenkins on May 29, 1962, discloses a water saving attachment for flush boxes. U.S. Pat. No. 3,982,283, issued to Goldring on Sep. 28, 1976, discloses a water conserving device for a flushing apparatus. U.S. Pat. No. 4,364,129, issued to Schonger on Dec. 21, 1982, discloses a water saving flush system. U.S. Pat. No. 4,455,694, issued to Dymon on Jun. 26, 1984, discloses a clip-on attachment for conserving water during the flushing of a toilet. U.S. Pat. No. 5,073,995, issued to Jennison et al. on Dec. 24, 1991, discloses a universal toilet tank water saving device. U.S. Pat. No. 5,129,110, issued to Richter on Jul. 14, 1992, discloses a selectable toilet-water-level flushing system. U.S. Pat. No. 5,428,848, issued to Battle on Jul. 4, 1995, discloses a flush regulator.

The foregoing patent information reflects the state of the art of which the inventor is aware and is tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

Thus, there remains a need for an apparatus and system for a toilet flush system adapted to control the flow of water and thereby conserve water. The technology described herein addresses these unmet needs.

BRIEF SUMMARY OF THE INVENTION

In various exemplary embodiments, the technology described herein provides water conservation devices, systems, and methods for use in a toilet system adapted to control the flow of water, and thereby conserve water, and allow a user to selectively control whether a full or partial flush is activated.

In one exemplary embodiment, the technology described herein provides a water conservation device for use within a toilet. The water conservation device includes: a connector having a base adapted for connectivity and placement adjacent to a traditional pole assembly and proximate to an opening valve, such as a flapper, within a tank of the toilet; and a flexible pressure arm integrally formed with the connector base and adapted to couple to the opening valve within the tank of the toilet and adapted to provide a pressure to the opening valve to lessen overall water utilized in each flush of the toilet and thereby conserve water. The water conservation device is adapted for either a total or partial flush of the toilet as selected by a user. The water conservation device also can include: a pair of arms integrally formed with the connector base, extending outwardly from each side, and adapted to couple to the traditional pole assembly within the tank of the toilet. The water conservation device further can include: a pair of feet integrally formed with the flexible pressure arm and each adapted to provide a pressure to the opening valve. The water conservation device also can include: a channel disposed between the pair of feet. The water conservation device can be a water resistant material. The water conservation device is thin and planar, adapted for flat transport, and adapted for foldout by a user and placement in the toilet tank coupled to the pole assembly and the opening valve. The water conservation device can include: an internal resistance element disposed within the connector base and adapted to provide greater rigidity and strength to the pressure arm. The internal resistance element can be a strip of spring steel.

In another exemplary embodiment, the technology described herein provides a toilet system. The toilet system includes: a tank; a bowl; a connector having a base adapted for connectivity and placement adjacent to a traditional pole assembly and proximate to an opening valve, such as a flapper, within the tank of the toilet; and a flexible pressure arm integrally formed with the connector base and adapted to couple to the opening valve within the tank of the toilet and adapted to provide a pressure to the opening valve to lessen overall water utilized in each flush of the toilet and thereby conserve water. The connector is adapted for either a total or partial flush of the toilet as selected by a user. The system also can include: a pair of arms integrally formed with the connector base, extending outwardly from each side, and adapted to couple to the traditional pole assembly within the tank of the toilet; a pair of feet integrally formed with the flexible pressure arm and each adapted to provide a pressure to the opening valve; and a channel disposed between the pair of feet. The water conservation device comprises a water resistant material.

In an alternative embodiment, the system can also include: a pair of wireless buttons, a first adapted for liquid flush and a second adapted for solid flush; and a wireless relay and a solenoid adapted to move a handle lever of the tank connected to the opening valve. The pair of wireless buttons and wireless relay are electronically, wirelessly coupled one to another for communication.

In at alternative embodiment, the system can also include: a sensor adapted for automatic recognition of an occurrence that justifies a flush; and a wireless relay and a solenoid adapted to move a handle lever of the tank connected to the opening valve. The sensor and wireless relay are electronically, wirelessly coupled one to another for communication.

In at alternative embodiment, the system can also include: a mechanical delay element comprising a reflective trap and adapted to control movement of the handle lever.

In at alternative embodiment, the system can also include: a mechanical delay element comprising a tether coupled at one end to the pressure arm of the water conservation device and coupled at a second end to a finger button at the flush handle, wherein the finger button is adapted for selective activation by a user to provide a mechanical delay to the pressure provided by the pressure arm to the opening valve; and an internal resistance element disposed within a base of the finger button adapted to provide a delay of a predetermined amount of time.

In yet another exemplary embodiment, the technology described herein provides a method for water conservation with a toilet. The method includes: utilizing a connector having a base adapted for connectivity and placement adjacent to a traditional pole assembly and proximate to an opening valve, such as a flapper, within a tank of the toilet and a flexible pressure arm integrally formed with the connector base and adapted to couple to the opening valve within the tank of the toilet and adapted to provide a pressure to the opening valve to lessen overall water utilized in each flush of the toilet and thereby conserve water; placing the connector adjacent to the traditional pole assembly and securing the connector to the traditional pole assembly; coupling the pressure arm to the opening valve within the tank of the toilet; and providing pressure from the pressure arm to the opening valve to restrict water flow and thereby conserve water with each flush of the toilet. The connector is adapted for either a total or partial flush of the toilet as selected by a user. The connector also can include a pair of arms integrally formed with the connector base, extending outwardly from each side, and adapted to couple to the traditional pole assembly within the tank of the toilet; a pair of feet integrally formed with the flexible pressure arm and each adapted to provide a pressure to the opening valve; and a channel disposed between the pair of feet. The method further can include: flushing the toilet with the pressure arm totally unrestricted and allowing the pressure arm to place a pressure to the opening valve, thereby limiting flush water from passage and conserving water; flushing the toilet with the pressure arm totally restricted from providing a pressure to the opening valve, thereby allowing a complete, normal flush, and in which no water is conserved; or flushing the toilet with the pressure arm partially restricted, based upon a specific flush need, providing a partially restricted pressure to the opening valve, and in which some water is conserved.

Advantageously, the water conservation device provides an easy to manufacture device that is preferably made of a single part. The single part is thin and planar, such that it can be mailed, transported, or the like and folded outwardly for installation in a toilet system. The device can be made of an inexpensive, water resistant material such as plastic. Also advantageously, the water conservation device is easy to install and requires minimal alteration to an existing toilet system. Further advantageously, the water conservation device can be coupled with use of electronic and/or mechanical system add-ons to further control and/or select the flush options of the toilet.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the technology described herein. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1A:
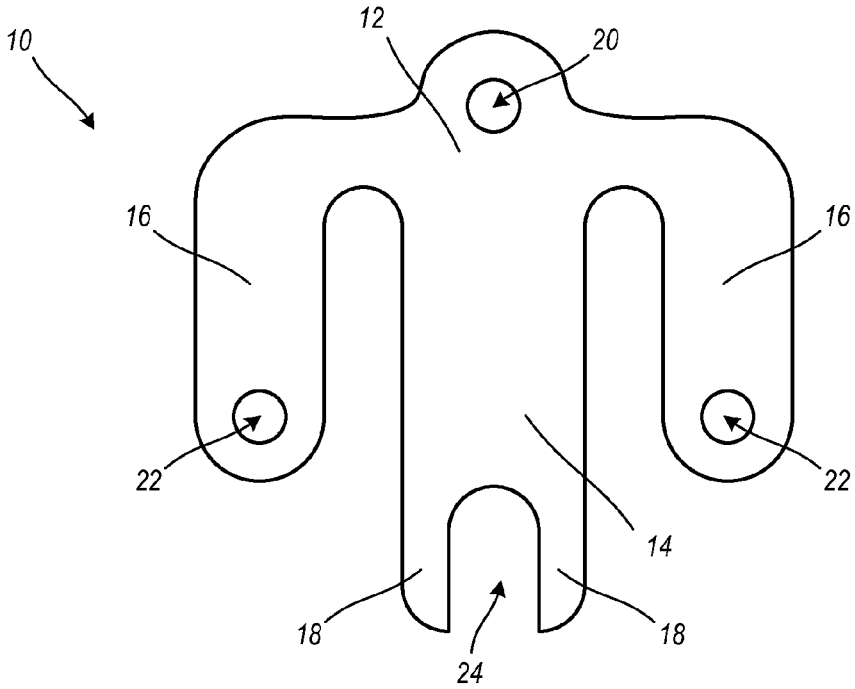
FIG. 1A is a front planar view of a water conservation device, according to an embodiment of the technology described herein.
Figure 1B:
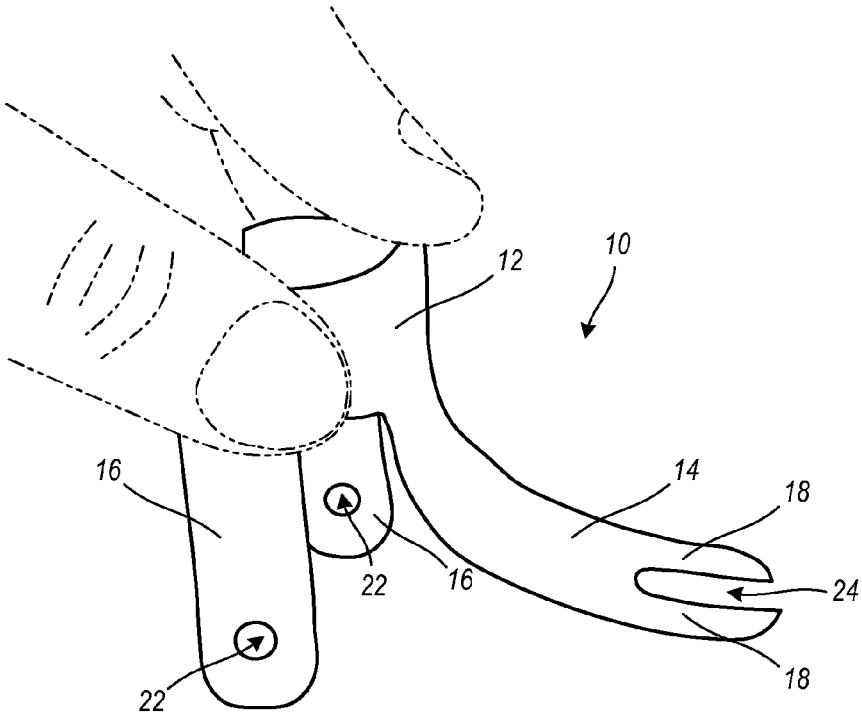
FIG. 1B is a side perspective view of the water conservation device depicted in FIG. 1A, illustrating, in particular, the shape of the generally planar device when in use in a non-planar configuration, according to an embodiment of the technology described herein.
Figure 2A:
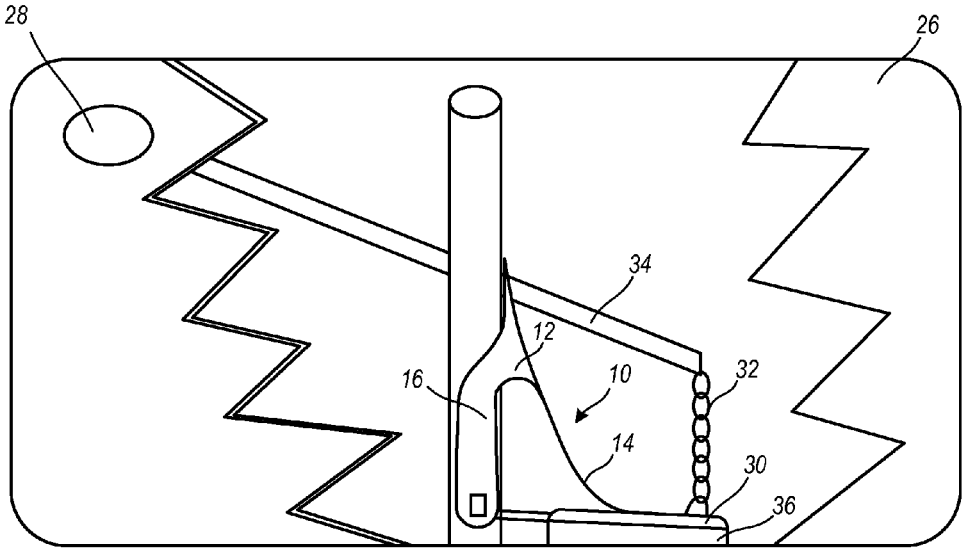
FIG. 2A is a side cross-sectional view of a toilet tank utilizing the water conservation device and in which the device is shown applying a pressure on the flapper, according to an embodiment of the technology described herein.
Figure 2B:
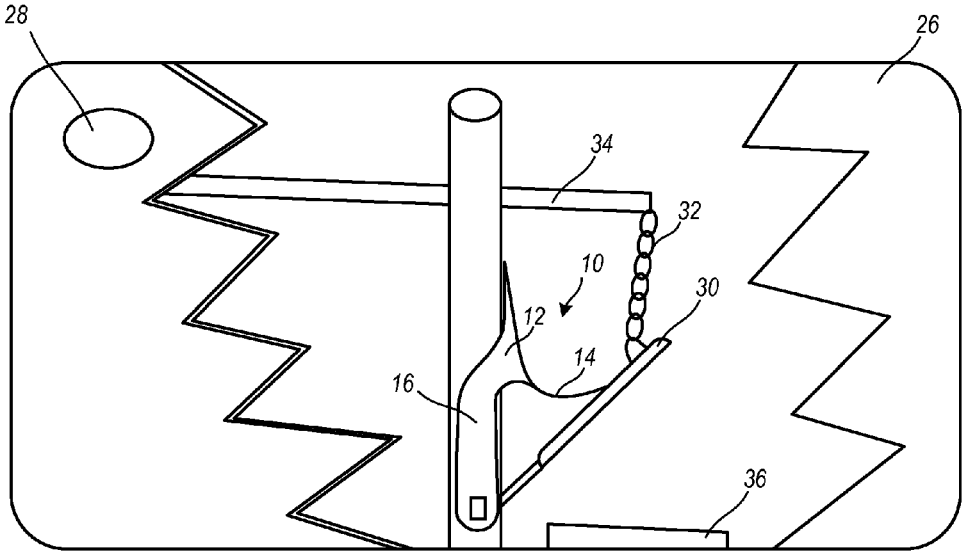
FIG. 2B is a side cross-sectional view of a toilet tank utilizing the water conservation device and in which the device is shown in a raised position while during a flush applying a pressure on the flapper.
Figure 3:
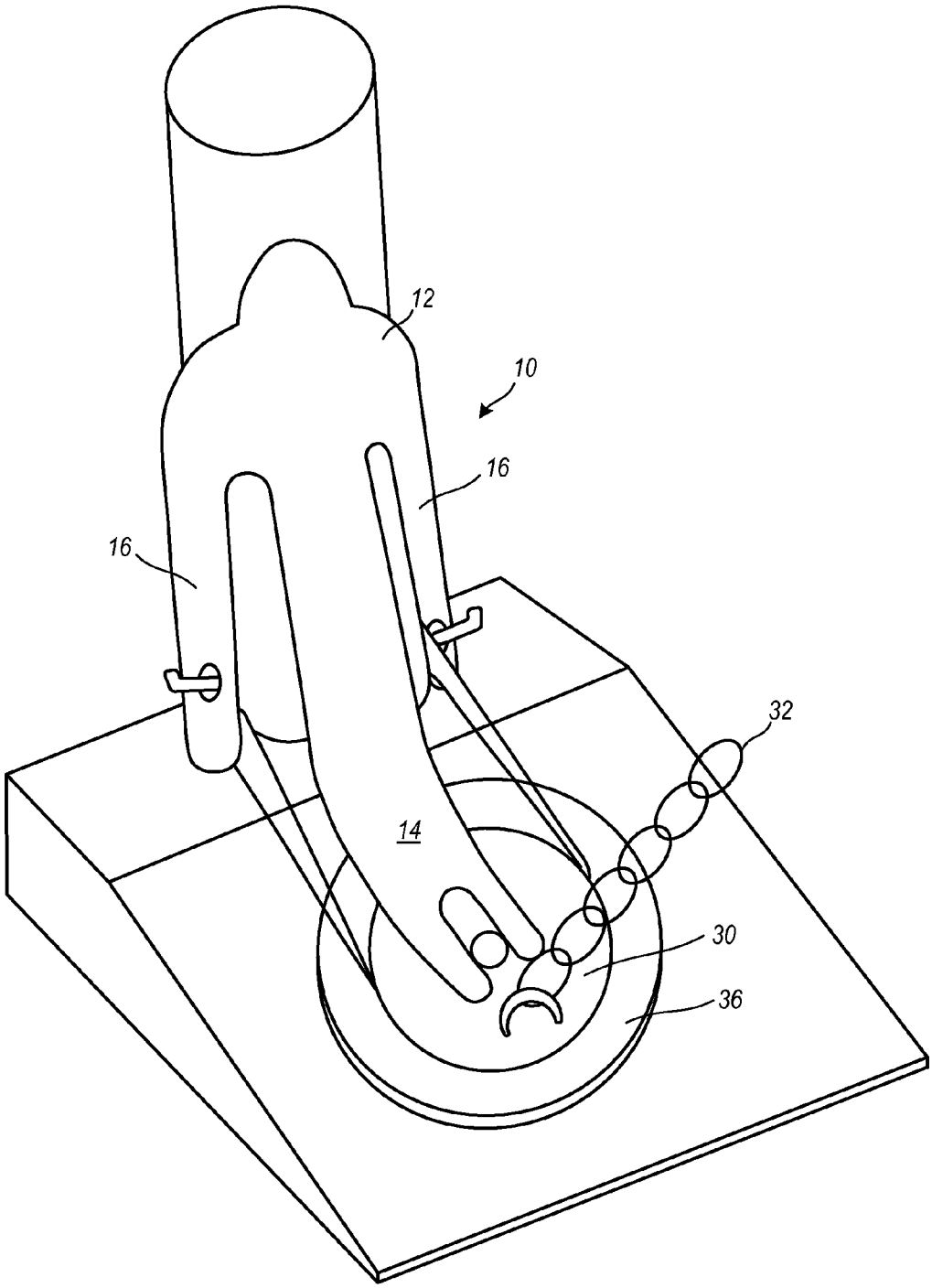
FIG. 3 is a front perspective view of the water conservation device shown installed over a flapper.

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides water conservation devices, systems, and methods for use in a toilet system adapted to control the flow of water, and thereby conserve water, and allow a user to selectively control whether a full or partial flush is activated.

Referring now to the Figures, in various exemplary embodiments, the technology described herein provides a water conservation device 10. In at least one embodiment, the device 10 is a connector having a base 12. The base 12 is adapted for connectivity and placement adjacent to a traditional pole assembly and proximate to a flapper 30 within a tank 26 of the toilet. Base aperture 20 is provided to facilitate attachment of the device 10 to the pole assembly.

The device 10 includes a flexible pressure arm 14 integrally formed with the connector base 12. The pressure arm 14 is adapted to couple to the flapper 30 within the tank 26 of the toilet and adapted to provide a pressure to the flapper 30 against the flush valve 36 to lessen overall water utilized in each flush of the toilet and thereby conserve water. As there are varying flushing needs in the use of a toilet, the water conservation device 10 is adapted for either a total or partial flush of the toilet as selected by a user.

The water conservation device 10 is preferably a water resistant material, such as a thin, durable plastic material. Alternative materials can be utilized so long as the device 10 remains lightweight, flat when not in use, and water-resistant. Additionally, in a planar state, used for storage and mailing, the device 10 resembles, generally, the shape of a man, with a trunk, arms, legs, feet, and the like.

The device 10 also includes a pair of arms 16 integrally formed with the connector base 12. The arms 16 extend outwardly from each side of the base 12. The arms 16 are adapted to couple to the traditional pole assembly within the tank 26 of the toilet. Arm apertures 22 are provided to facilitate attachment of the arms 16 of the device 10 to the pole assembly.

The device 10 also includes a pair of feet 18 integrally formed with the flexible pressure arm 14. Each foot 18 is adapted to provide a pressure to the flapper 30 and provide additional means with which to secure the device 10 to the flapper 30. The device 10 also can include a channel 24 disposed between the pair of feet 18. The channel provides an additional connectivity point to couple to the flapper 30.

Figure 13:
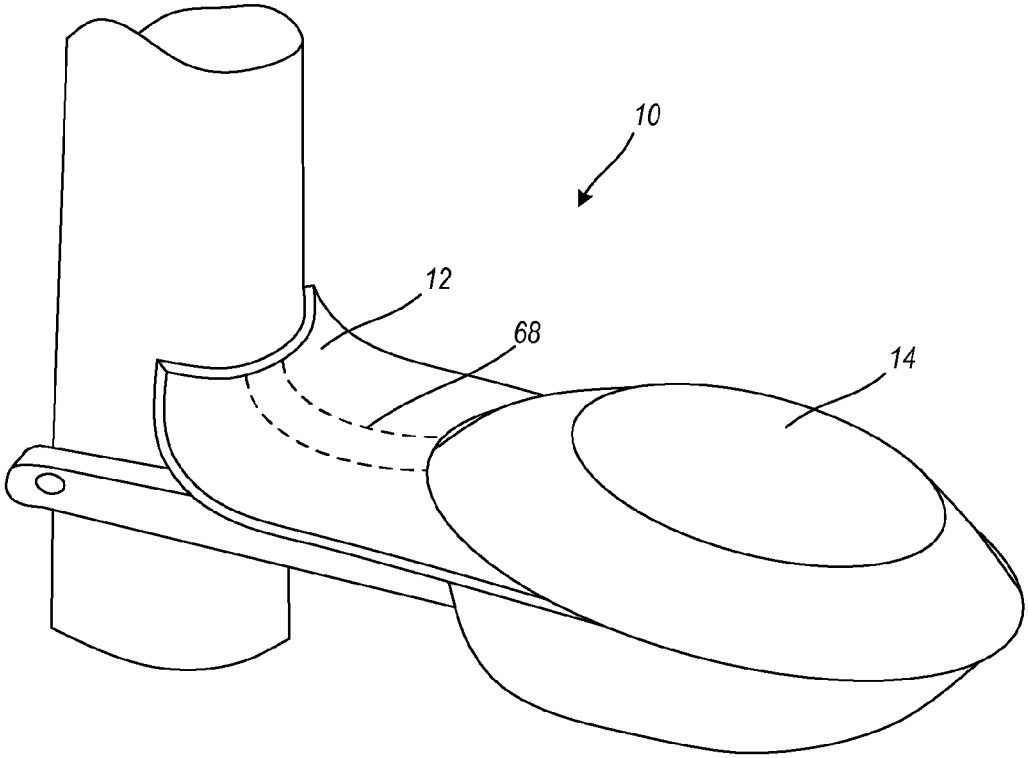
FIG. 13 is a front perspective diagram of the water conservation device wherein the device is stiffer and includes an embedded strip to provide stiffness, according to an embodiment of the technology described herein.

The device 10 can include an internal resistance element 68 disposed within the connector base 12. The resistance element 68 is adapted to provide greater rigidity and strength to the pressure arm 14. As depicted specifically in FIG. 13, the internal resistance element 68 can be a strip of spring steel, however the stiffening of device 10 can accomplished by other designs, e.g. both by an embedment and/or homogeneous design such as a dual durometer rubber design or molded rubber configuration.

In another exemplary embodiment, a toilet system is provided. The toilet system includes: a tank 26; a bowl 42; a connector 10 having a base 12 adapted for connectivity and placement adjacent to a traditional pole assembly and proximate to a flapper 30 within the tank 26 of the toilet; and a flexible pressure arm 14 integrally formed with the connector base 12 and adapted to couple to the flapper 30 within the tank 26 of the toilet and adapted to provide a pressure to the flapper 14 to lessen overall water utilized in each flush of the toilet and thereby conserve water. The connector 10 is adapted for either a total or partial flush of the toilet as selected by a user.

In use, as a user flushes the toilet by depressing the flush handle 28, the handle lever is activated to pull upwardly against the chain 32, or like configuration, to pull upwardly on the flapper 30. As the flapper 30 is lifted, water can pass through the flush valve 36 into the bowl 42. The water conservation device 10 provides a pressure against the flapper 30 to lessen the usage of water in each flush.

Figure 4A:
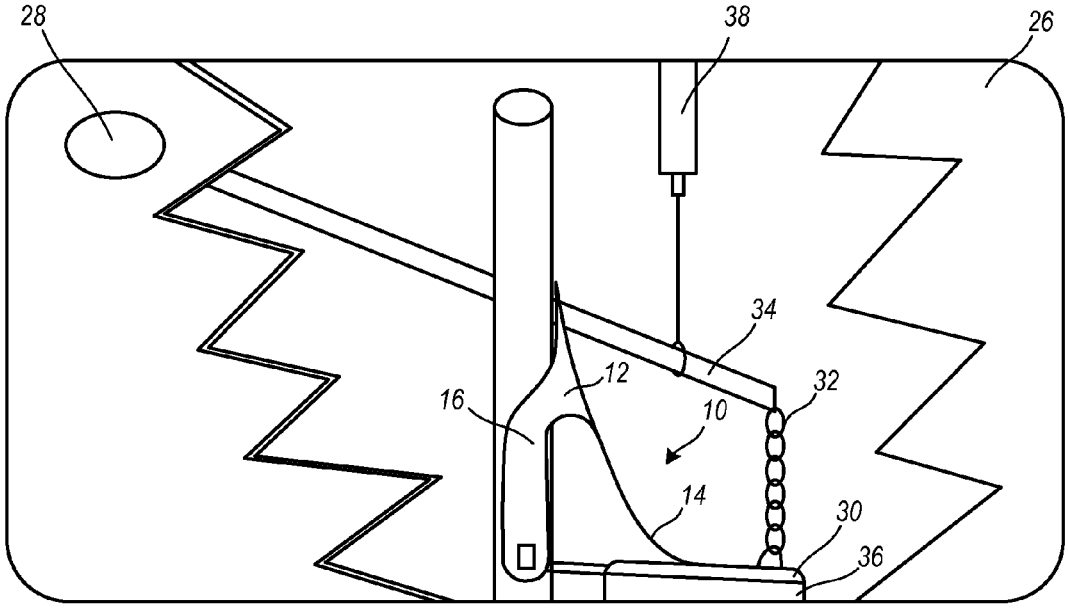
FIG. 4A is a side cross-sectional view of a toilet tank utilizing the water conservation device, illustrating a solenoid and wireless relay, according to an embodiment of the technology described herein.
Figure 4B:
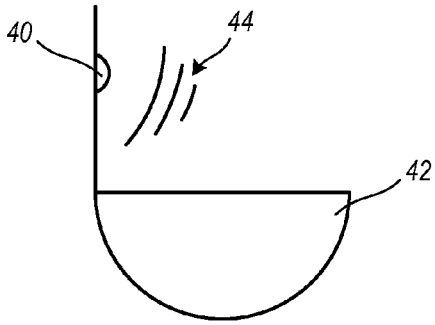
FIG. 4B is a side view of a bowl and wireless sensor, adapted to communicate with the wireless relay and activate the solenoid, according to an embodiment of the technology described herein.
Figure 5:
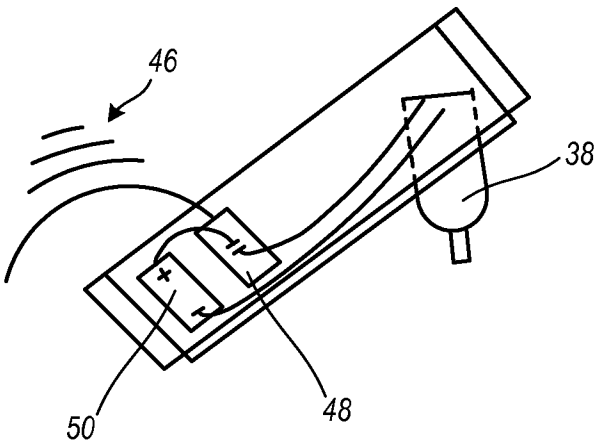
FIG. 5 is a cross-sectional view of wireless buttons and the solenoid, wireless relay, and power supply.
Figure 5:
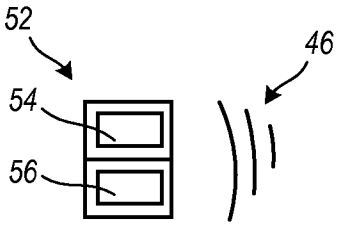
Figure 6A:
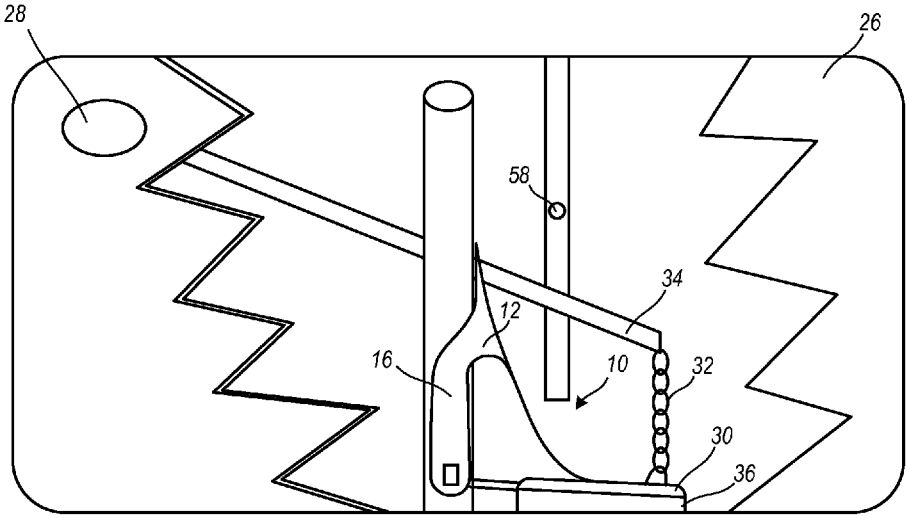
FIG. 6A a side cross-sectional view of a toilet tank utilizing the water conservation device, illustrating, in particular, a trap adapted to provide a mechanical delay for a full flush, according to an embodiment of the technology described herein.
Figure 6B:
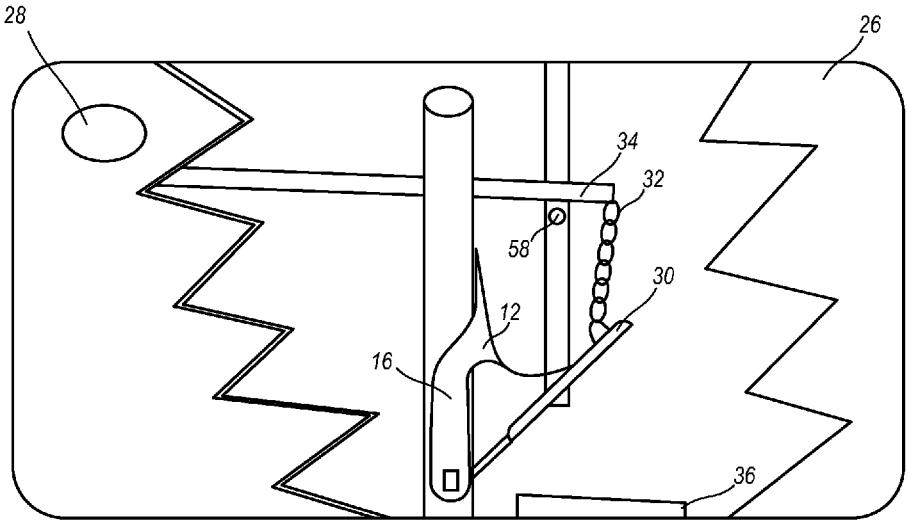
FIG. 6B is a side cross-sectional view of a toilet tank utilizing the water conservation device, illustrating, in particular, a trap and the water conservation device is a raised position.

In at alternative embodiment, and as depicted specifically in FIGS. 4A, 4B, and 5, the system can also include a pair of wireless buttons 52, a first 54 adapted for liquid flush and a second 56 adapted for sold flush. Dependent upon the flush need, a user operatively can select which button, 54 or 56 to push. By way of example, if a user selects the first button 54 adapted for liquid flush, a wireless signal 46 is transmitted. In this embodiment, the system includes a wireless relay 48 and a solenoid 38. The wireless relay 48 is in electronic wireless communication with the pair of wireless buttons 52. The wireless relay 48 receive wireless signal 46. The solenoid 38 is adapted to move the handle lever 34 of the tank 26 connected to the flapper 30. The wireless relay 48 can be powered by a local direct power source 50, such as a battery, or the like.

In at alternative embodiment, the system can also include a sensor 40. The sensor 40 is adapted for automatic recognition of an occurrence that justifies a flush. By way of example, as the sensor 40 detects a certain level of ultrasonic waves 44, it knows which flush level to generate. In this embodiment, the system includes a wireless relay 48 and a solenoid 38. The wireless relay 48 is in electronic wireless communication with the sensor 40. The solenoid 38 is adapted to move the handle lever 34 of the tank 26 connected to the flapper 30 based upon the flush need as detected by the sensor 40.

Figures 7A, 7B, 7C, 7D:
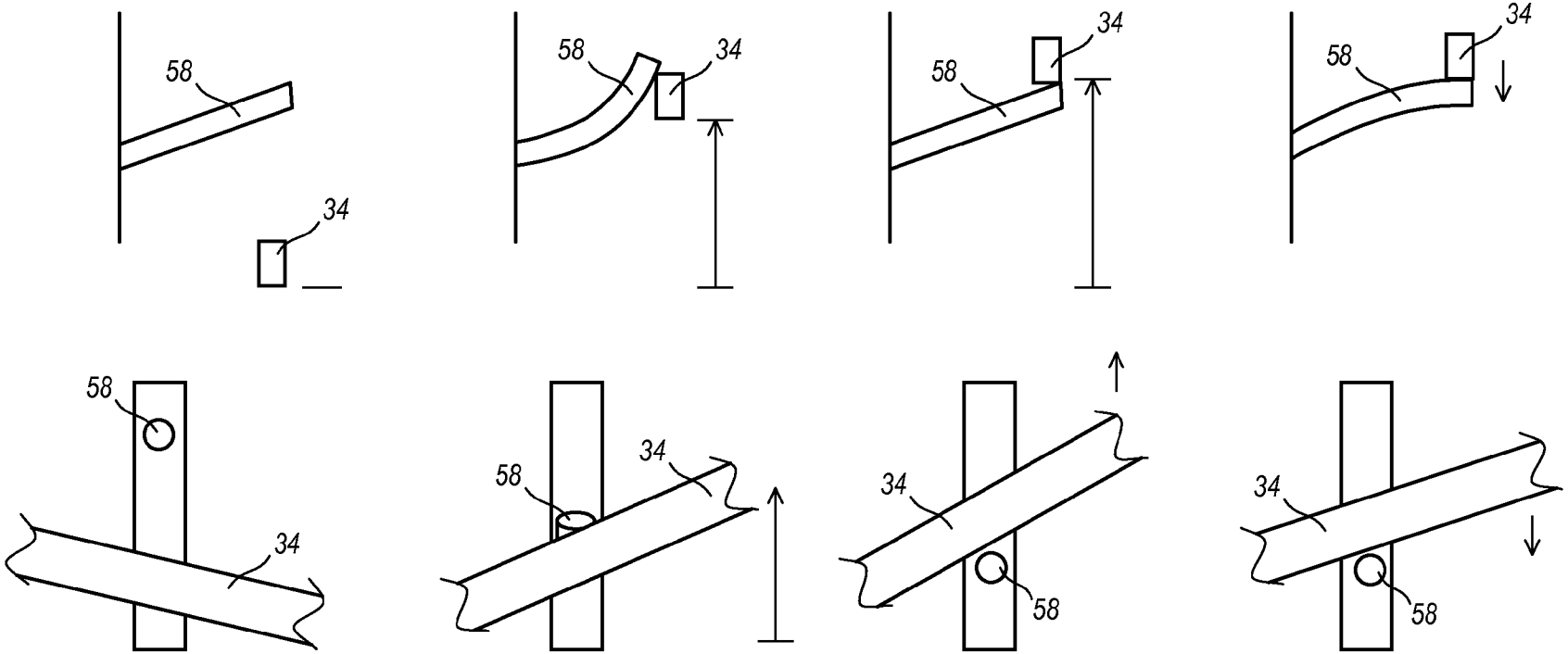
FIG. 7A through 7D are schematic diagrams illustrating the relationship between the trap and handle lever at various positions in use and at rest.
Figure 8A:
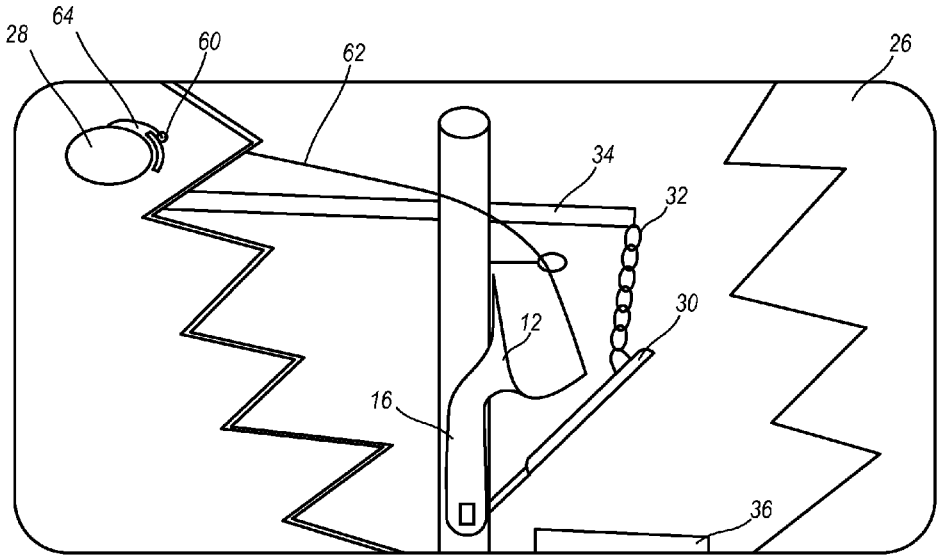
FIG. 8A is a side cross-sectional view of a toilet tank utilizing the water conservation device, illustrating, in particular, a finger push button, according to an embodiment of the technology described herein.
Figure 8B:
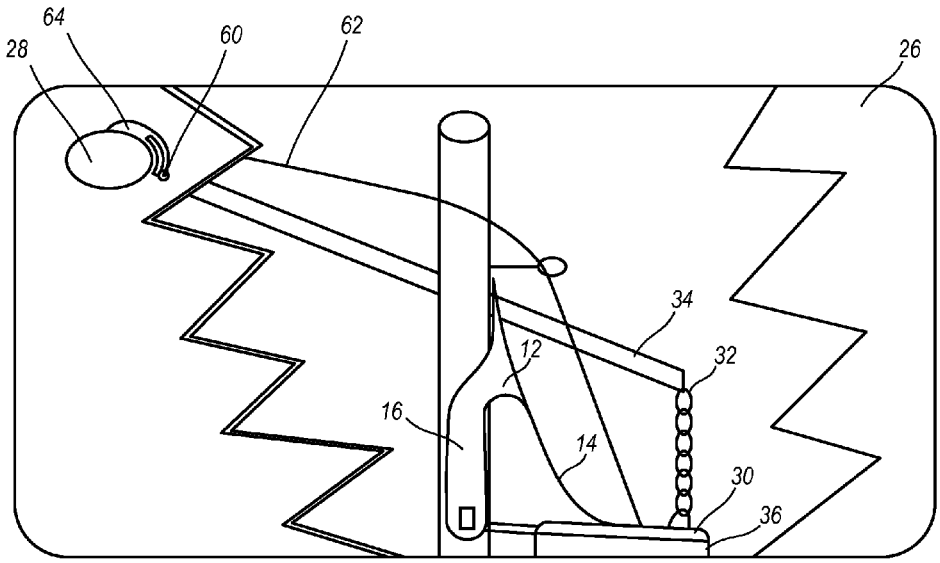
FIG. 8B is a side cross-sectional view of a toilet tank utilizing the water conservation device, illustrating, in particular, a finger push button and the water conservation device in a downward position over the flapper.
Figure 9B:
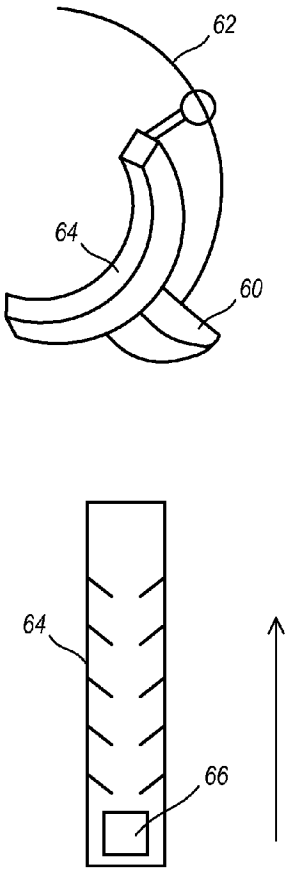
FIGS. 9A and 9B are schematic diagrams illustrating the affect use of the push button has on an internal resistance element located within the base of the push button.
Figure 9A:
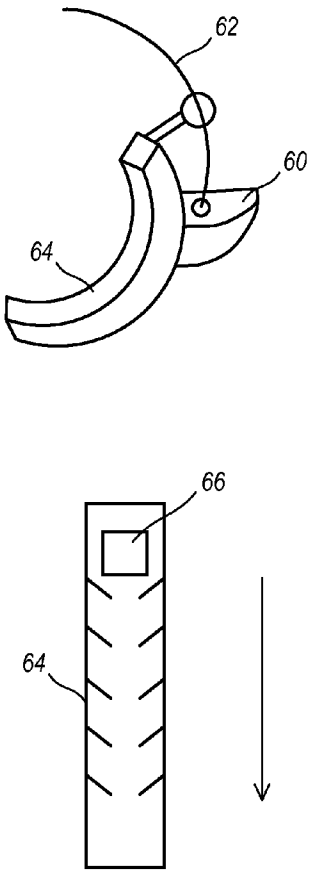
Figure 10A:
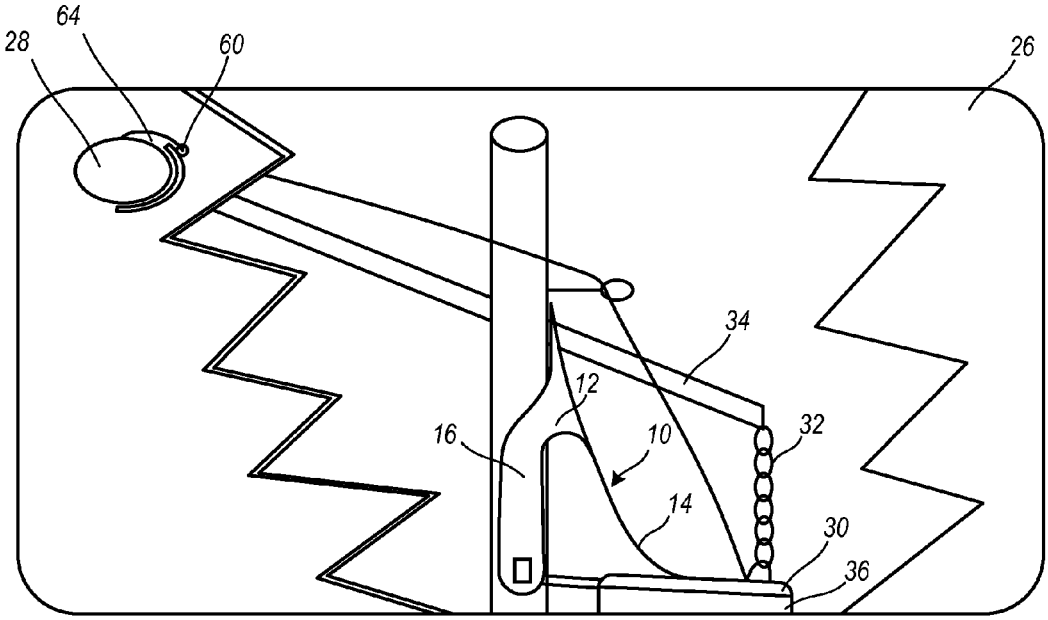
FIGS. 10A, 10B, 11A, 11B, 12A, and 12B are diagrams illustrating the side cross-sectional view of a toilet tank utilizing the water conservation device and close ups of the push button while illustrating the flapper in various stages: closed, half-open, and all open, according to an embodiment of the technology described herein.
Figure 10B:
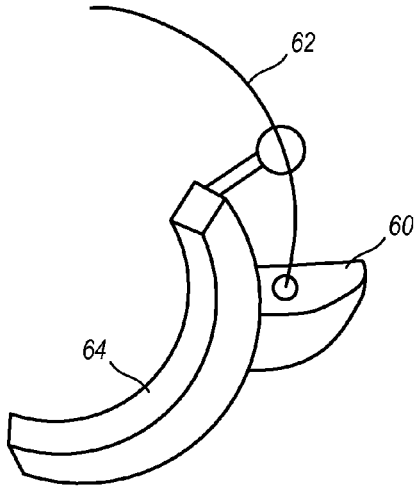
Figure 11A:
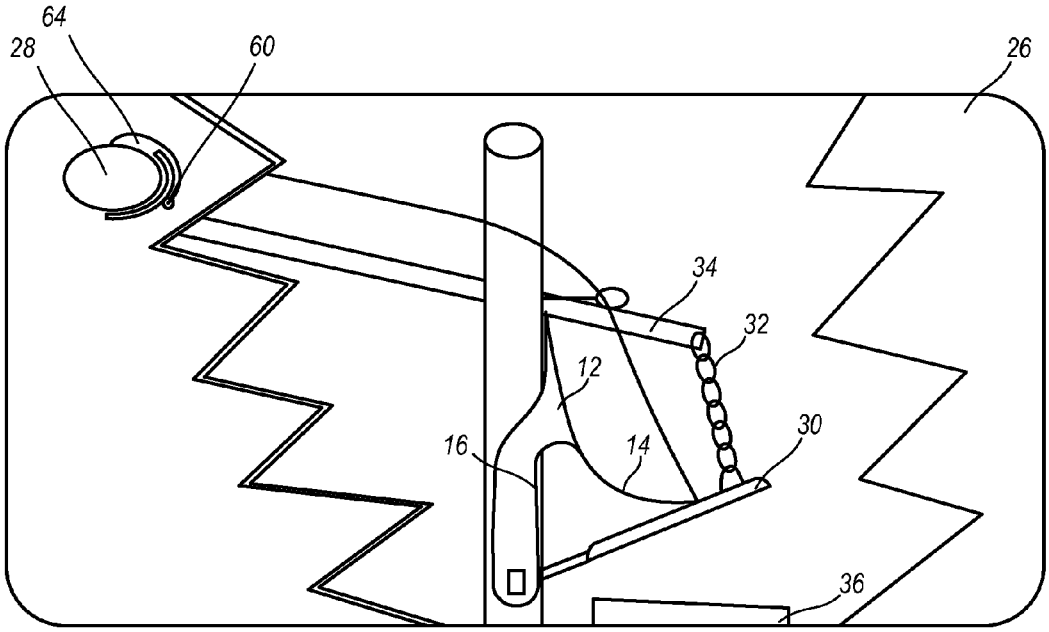
Figure 11B:
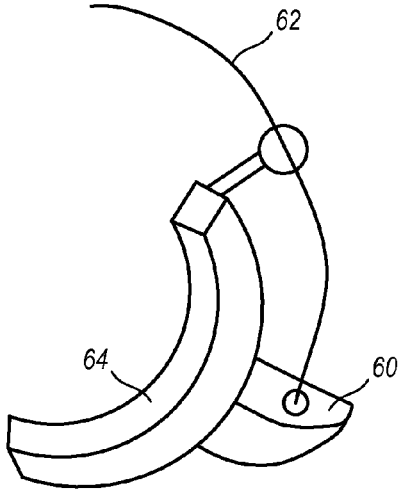
Figure 12A:
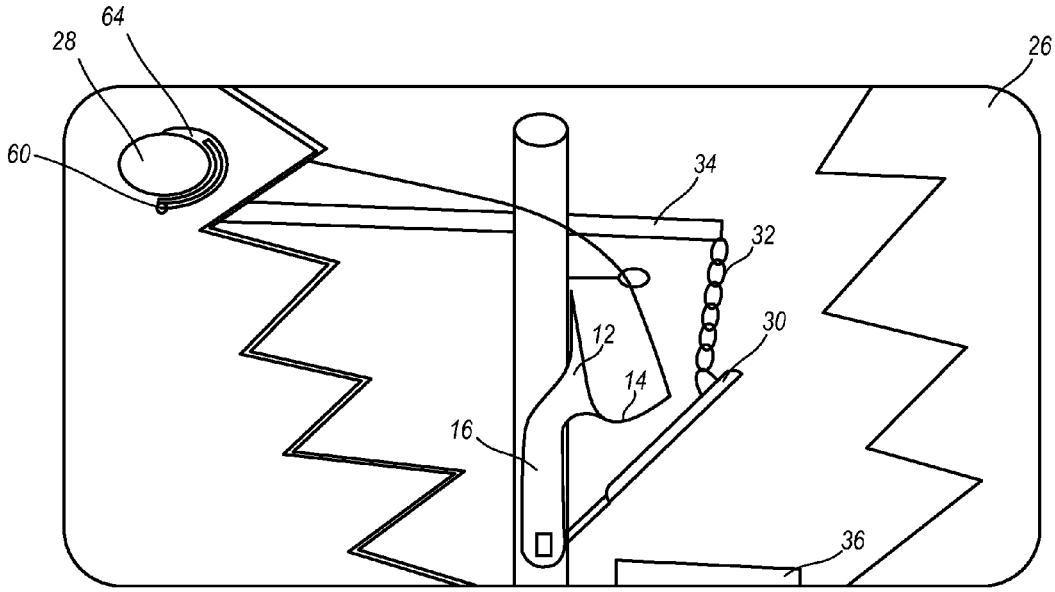
Figure 12B:
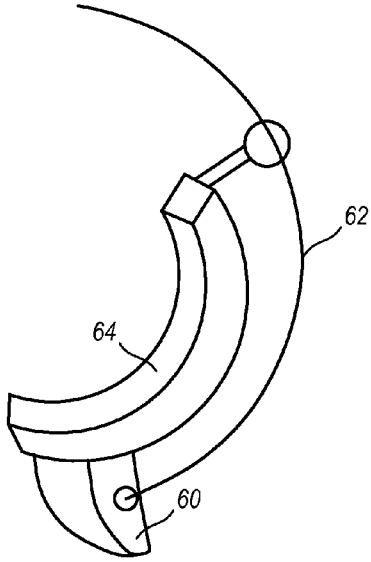

In at alternative embodiment, and as depicted specifically in FIGS. 6A, 6B, 7A, 7B, 7C, 7D, the toilet system can also include a mechanical delay element. In this embodiment, the mechanical delay element is a reflective trap 58. The reflective trap 58 is adapted to control movement of the handle lever 34. By way of example, the trap 58 can be installed on a tank wall and be secured with the weight of the tank lid. The sequence of motion is depicted in FIG. 7A, a steady position; FIG. 7B, rotating the flush handle; FIG. 7C, rotating the flush handle all the way; and FIG. 7D, a three second mechanical delay for a full flush.

In at alternative embodiment, and as depicted specifically in FIGS. 8A through 12B, the system can also include a mechanical delay element. In this embodiment, the mechanical delay element is a tether 62 coupled at one end to the pressure arm 14 of the water conservation device 10 and coupled at a second end to a finger button 60 at the flush handle 28. The finger button 60 is adapted for selective activation by a user to provide a mechanical delay to the pressure provided by the pressure arm 14 to the flapper 30. An internal resistance element 66 is disposed within a base 64 of the finger button 60 and is adapted to provide a delay of a predetermined amount of time. In FIG. 9A the internal resistance element 66 is shown in a steady position. In FIG. 9B the internal resistance element 66 is shown with a three second mechanical delay for a full flush.

In at least one embodiment, a method for water conservation with a toilet is disclosed. The method includes one or more of the following steps:

utilizing a connector 10 having a base 12 adapted for connectivity and placement adjacent to a traditional pole assembly and proximate to a flapper 30 within a tank 26 of the toilet and a flexible pressure arm 14 integrally formed with the connector base 12 and adapted to couple to the flapper 30 within the tank 26 of the toilet and adapted to provide a pressure to the flapper 30 to lessen overall water utilized in each flush of the toilet and thereby conserve water placing the connector 10 adjacent to the traditional pole assembly and securing the connector to the traditional pole assembly coupling the pressure arm 14 to the flapper 30 within the tank 26 of the toilet providing pressure from the pressure arm 14 to the flapper 30 to restrict water flow and thereby conserve water with each flush of the toilet flushing the toilet with the pressure arm totally unrestricted and allowing the pressure arm to place a pressure to the flapper, thereby limiting flush water from passage and conserving water flushing the toilet with the pressure arm totally restricted from providing a pressure to the flapper, thereby allowing a complete, normal flush, and in which no water is conserved flushing the toilet with the pressure arm partially restricted, based upon a specific flush need, providing a partially restricted pressure to the flapper, and in which some water is conserved.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the technology described herein and are intended to be covered by the following claims.

What is claimed is:

1. A water conservation device for use within a toilet, the device comprising:

a thin and planar connector, in a pre-installed state and flat when not in use, configured for permit either a total or partial flush of the toilet, having a base configured to connectivity and placement adjacent to a toilet pole assembly and proximate to a flapper that covers an opening valve within a tank of the toilet;

a pair of arms integrally formed with the base, the pair of arms extending outwardly from each side of the base, in a planar state with the base prior to installation, each arm having an arm aperture formed therein, each aperture configured to receive a tab from the toilet pole assembly to secure the base to the toilet pole assembly; and a flexible pressure arm, bendable in a curved direction upwardly from the flapper over the opening valve within the tank as the flapper is raised, integrally formed with the connector base, in a planar state with the base and pair of arms prior to installation, and configured to couple to the opening valve within the tank of the toilet and configured to provide a pressure downwardly upon a top center portion of the opening valve to lessen overall water utilized in each flush of the toilet and thereby conserve water;

wherein the thin and planar connector, the pair of arms, and the flexible pressure arm are integrally formed and comprise a single, one-part device; and wherein an inherent tension is created is created between the base and the flexible pressure arm upon installation to facilitate the downward pressure to the top center portion of the flapper above the opening valve.

2. The water conservation device of claim 1, wherein the water conservation device comprises a water resistant material.

3. The water conservation device of claim 2, further comprising:

an internal resistance element disposed within the connector base, in the same place as the connector base, prior to installation, and adapted to provide greater rigidity and strength to the pressure arm.

4. The water conservation device of claim 3, wherein the internal resistance element comprises a strip of spring steel.

5. A method for water conservation with a toilet, the method comprising:

utilizing a thin, planar water-resistant connector, in a pre-installed state and flat when not in use, having a base configured for connect and place adjacent to a toilet pole assembly and proximate to a flapper that covers an opening valve within a tank of the toilet, wherein the connector further comprises a pair of arms integrally formed with the connector base, extending outwardly from each side of the base and in a planar state with the base prior to installation, and configured to couple to the traditional pole assembly within the tank of the toilet by an arm aperture disposed in each arm, and a flexible pressure arm, bendable in a curved direction upwardly from the flapper over the opening valve within the tank as the flapper is raised, integrally formed with the connector base, in a planar state with the base and pair of arms prior to installation, and configured to couple to the opening valve within the tank of the toilet and configured to provide a pressure downwardly upon a top center portion of the opening valve to lessen overall water utilized in each flush of the toilet and thereby conserve water, wherein a pair of feet is integrally formed with the flexible pressure arm, in a planar state with the flexible pressure arm prior to installation and each is adapted to provide a pressure to the opening valve, and a channel disposed between the pair of feet;

placing the connector adjacent to the toilet pole assembly and securing the connector to the toilet pole assembly;

coupling the pressure arm to the opening valve within the tank of the toilet;

providing pressure from the pressure arm to the opening valve to restrict water flow and thereby conserve water with each flush of the toilet;

wherein the connector is adapted for either a total or partial flush of the toilet as selected by a user.

6. The method of claim 5, further comprising: flushing the toilet with the pressure arm totally unrestricted and allowing the pressure arm to place a pressure to the opening valve, thereby limiting flush water from passage and conserving water.

7. The method of claim 5, flushing the toilet with the pressure arm totally restricted from providing a pressure to the opening valve, thereby allowing a complete, normal flush, and in which no water is conserved.

8. The method of claim 5, flushing the toilet with the pressure arm partially restricted, based upon a specific flush need, providing a partially restricted pressure to the opening valve, and in which some water is conserved.

* * * * *